US009462659B2

(12) United States Patent
Feng

(10) Patent No.: US 9,462,659 B2
(45) Date of Patent: Oct. 4, 2016

(54) DIMMING DRIVE METHOD, DEVICE AND DIMMABLE LIGHT

(75) Inventor: Lin Feng, Shenzhen (CN)

(73) Assignees: Chao Liu, Shenzhen, Guangdong (CN); ALL SUNNSHINE LIMITED, Hong Kong (CN)

( * ) Notice: Subject to any disclaimer, the term of this patent is extended or adjusted under 35 U.S.C. 154(b) by 236 days.

(21) Appl. No.: 13/699,302

(22) PCT Filed: Feb. 16, 2011

(86) PCT No.: PCT/CN2011/071040

§ 371 (c)(1),
(2), (4) Date: Jan. 30, 2013

(87) PCT Pub. No.: WO2011/143957

PCT Pub. Date: Nov. 24, 2011

(65) Prior Publication Data

US 2013/0119890 A1 May 16, 2013

(30) Foreign Application Priority Data

May 30, 2010 (CN) ..... 2010 1 0176821

(51) Int. Cl.
*H05B 37/02* (2006.01)
*H05B 33/08* (2006.01)
*H05B 41/392* (2006.01)

(52) U.S. Cl.
CPC ..... *H05B 37/02* (2013.01); *H05B 33/0845* (2013.01); *H05B 41/3921* (2013.01)

(58) Field of Classification Search
CPC ..... H05B 37/0272; H05B 33/0854; H05B 33/0803; H05B 37/03; H05B 33/0815; H05B 33/0842; H05B 37/02; H05B 33/0845; H05B 33/0848
USPC ..... 315/307, 86, 291, 308, 154, 158, 210, 315/294; 362/20, 157, 276
See application file for complete search history.

(56) References Cited

U.S. PATENT DOCUMENTS

2010/0052574 A1* 3/2010 Blakeley et al. ..... 315/307
2010/0271802 A1* 10/2010 Recker ..... H05B 33/0803 362/20
2013/0200793 A1* 8/2013 Liao et al. ..... 315/86

* cited by examiner

*Primary Examiner* — Minh D A

(57) ABSTRACT

A method for driving light adjustments, a device therefor and a light adjustable lamp thereof are disclosed. The method includes: connecting a light source driving circuit which supplies a light source and an MCU with electricity and then the light source driving circuit driving the light source to vary brightness; after disconnecting the light source driving circuit, a temporary power supplying circuit continuing to power the MCU; when the light source is varying brightness and at an instant of disconnecting the light source driving circuit, the MCU obtaining a brightness state of the light source and storing information about the brightness state; after the temporary power supplying circuit is drained, the information vanishing; if the light source driving circuit is connected before the vanishing, the light source working constantly according to the information; and if the light source driving circuit is connected after the vanishing, the light source varying brightness.

9 Claims, 5 Drawing Sheets

DIMMING DRIVE METHOD, DEVICE AND DIMMABLE LIGHT

CROSS REFERENCE OF RELATED APPLICATION

This is a U.S. National Stage under 35 U.S.C 371 of the International Application PCT/CN2011/071040, filed Feb. 16, 2011, which claims priority under 35 U.S.C. 119(a-d) to CN 201010176821.2, filed May 20, 2010.

BACKGROUND OF THE PRESENT INVENTION

1. Field of Invention

The present invention relates to a field of lighting lamp control technology, and more particularly to a method for driving light adjustments, a device therefor and a light adjustable lamp comprising the device, wherein the device and an on-off switch together control and adjust brightness of a light source.

2. Description of Related Arts

Under an increasing shortage of energy resources, the energy saving of the lamps are becoming more and more important. Conventionally, the energy saving of lighting lamps mainly aims at replacing conventional incandescent lamps with energy-saving lamps, such as the fluorescent lamps and the LED, and pays little attention to the light adjustment technology which effectively saves energy by duly adjusting brightness of the lamps. On one hand, researches about the light adjustment technology are few; on the other hand, consumers have the demand of light adjustment technology, but have no technical supports. When purchasing the lighting lamps, the consumers are always bothered about choosing what power of the lamps to satisfy lighting demand; and after the lamps with certain power are purchased, a dilemma that most of such high power is unnecessary often occurs. Moreover, the conventional home lighting lamps only have switching functions without light adjustments and thus the lamps have to be switched on even if only dim light is demanded, which results in a great waste. Existing bedside lamps at some hotels have functions of adjusting brightness, but the brightness adjustments are accomplished via knobs, which is basically impossible for home lighting because most existing home walls are installed with on-off switches, instead of the knobs, to switch off the lamps. Further, if the knobs are used for the light adjustments, the common on-off switches are required to be replaced with the knobs, which adds many engineering costs; because of potential danger of electric shock during replacing the switches, professional electricians are needed to do the replacing, which undoubtedly further adds labor cost of the replacing; and the on-off switches are abandoned while the knobs are used, which further increases product costs of the knobs. As a result, such a light adjustment technology is hardly widely applied on market unless for the lighting construction to-be-started. Some relatively advanced remote control light adjustment technologies also appear on market. The remote control light adjustment technologies require no extra construction and no labor costs of replacing, but it is difficult to keep remote controllers and turning on the lamps often fails because of the drained remote controllers.

The field of commercial lighting has the demand not only for the brightness adjustments, but also for color adjustments. Similarly, the color adjustments also require providing additional controlling devices rather than the on-off switches, which adds the costs of the light adjustment. Certainly, the home lighting also has potential demand of the color adjustments, but no conventional color adjustment technology via the on-off switches ever appears.

A Chinese patent having an application number of 200810135921.3, searched out by the inventor, discloses a device for driving light adjustments and a method therefor. The device cooperates with an LED driver and changes brightness via calculating a frequency of a switch switching between ON and OFF, so as to enable the LED driver to adjust light. The device is only able to discretely adjust the brightness because of calculating the frequency of the switch switching between ON and OFF to change the brightness. The brightness can be divided into several grades and each grade of brightness corresponds to a certain frequency of the switch switching between ON and OFF by the switch. The device is unable to linearly and freely adjust the brightness. Meanwhile, the brightness adjustment requires frequently switching between ON and OFF, leading to frequent lightening and extinguishing of LED lamps, which is cumbersome and uncomfortable for human eyes and, more importantly, reduces service lives of the lamps.

SUMMARY OF THE PRESENT INVENTION

An object of the present invention is to solve above technical problems and provide a method for driving light adjustments, a device therefor and a light adjustable lamp, wherein the device cooperates with an on-off switch to linearly and freely adjust brightness of a light source correspondent to on and off signal of the on-off switch by collecting the on and off signal. The present invention has a simple controlling manner and low upgrading costs; and during adjusting the light, the light is kept from being extinguished, so as to bring convenience to the light adjustments without reducing a service life of the light source.

The light source of the present invention comprises lamps whose light sources are driven to work via electronic drivers or electronic ballasts, such as fluorescent lamps and LED lamps.

The present invention adopts following specific technical solutions.

The present invention provides a method for driving light adjustments comprising following steps of:

for a first time connecting a light source driving circuit which supplies a light source and an MCU with electricity and thereafter driving the light source to gradually vary brightness according to a predefined firmware program by the light source driving circuit which is controlled by the MCU;

disconnecting the light source driving circuit and then a temporary power supplying circuit continuing to supply the MCU with electricity;

when the light source is in a state of gradually varying the brightness and at an instant of disconnecting the light source driving circuit, the MCU obtaining a temporary brightness state of the light source at the instant and the MCU temporarily storing information about the brightness state which is constant;

after the temporary power supplying circuit is drained, the stored information about the brightness state vanishing;

connecting the light source driving circuit when the stored information about the brightness state remains and then driving the light source to work constantly according to the information about the brightness state by the light source driving circuit which is controlled by the MCU; and connecting the light source driving circuit after the stored information about the brightness state vanishes and then driving the light source to gradually vary the brightness according to the predefined firmware program by the light source driving circuit which is controlled by the MCU.

The light source driving circuit comprises energy storing elements which continue to supply the light source with electricity after the light source driving circuit stops supplying the light source with electricity.

The energy storing elements comprise one kind or more than one kind of capacitors, inductors and cells.

The method further comprises following steps of:

when the light source is working at the constant brightness state and the information about the constant brightness state remains, disconnecting the light source driving circuit and the MCU eliminating the stored information about the constant brightness state.

The step of "when the light source is in a state of gradually varying the brightness and at an instant of disconnecting the light source driving circuit, the MCU obtaining a temporary brightness state of the light source at the instant and the MCU temporarily storing information about the brightness state which is constant" specifically comprises following steps of:

when the light source is at the state of gradually varying the brightness and at the instant of disconnecting the light source driving circuit, the MCU obtaining a period of the light source driving circuit from connecting to disconnecting, then searching out the constant brightness state of the light source corresponding to the period in the predefined firmware program and temporarily storing the information about the constant brightness state.

The step of "when the light source is in a state of gradually varying the brightness and at an instant of disconnecting the light source driving circuit, the MCU obtaining a temporary brightness state of the light source at the instant and the MCU temporarily storing information about the brightness state which is constant specifically comprises following steps of:

when the light source is at the state of gradually varying the brightness and at the instant of disconnecting the light source driving circuit, the MCU obtaining at least one of a current value and a voltage value of an output terminal of the light source driving circuit at the instant and then temporarily storing the obtained value or the obtained values.

The present invention further provides a device for driving light adjustments comprising a light source driving circuit. The device further comprises an MCU and a temporary power supplying circuit. The temporary power supplying circuit is for supplying the MCU with electricity after the light source driving circuit stops supplying electricity. The MCU comprises a current detecting module, an analyzing and processing module and a storage module. The current detecting module is for obtaining connecting signal or disconnecting signal of the light source driving circuit and sending the obtained signal into the analyzing and processing module. The storage module is for storing a firmware program of gradually varying brightness of a light source and information about a constant brightness state of the light source. After the temporary power supplying circuit stops supplying electricity, the stored information about the constant brightness state vanishes; then the analyzing and processing module obtains the connecting signal or the disconnecting signal of the light source driving circuit and the firmware program of gradually varying the brightness of the light source or the information about the constant brightness state stored in the storage module for analyzing and processing, generates signal for adjusting the brightness of the light source and sends the signal into the light source driving circuit; and then the light source driving circuit adjusts the brightness of the light source according to the controlling signal, specifically as follows:

for a first time connecting the light source driving circuit and thereafter the analyzing and processing module generating a signal for controlling the light source driving circuit which drives the light source to gradually vary the brightness of the light source according to the predefined firmware program;

when the light source is at a state of gradually varying the brightness and after the light source driving circuit is disconnected, the analyzing and processing module obtaining the constant brightness state at an instant of disconnecting the light source driving circuit and then temporarily storing information about the constant brightness state;

connecting the light source driving circuit when the information about the constant brightness state remains and the analyzing and processing module generating a signal for controlling the light source driving circuit which drives the light source to work according to the information about the constant brightness state; and connecting the light source driving circuit after the information about the constant brightness state vanishes and the analyzing and processing module generating the signal for controlling the light source driving circuit which drives the light source to gradually vary the brightness according to the firmware program.

The light source driving circuit comprises energy storing elements which continue to supply the light source with electricity after the light source driving circuit stops supplying the light source with electricity.

The analyzing and processing module is further for eliminating the stored information about the constant brightness state after the light source driving circuit is disconnected, when the light source is working at the constant brightness state and the information about the constant brightness state remains.

The MCU further comprises a timing module for obtaining the period of the light source driving circuit from connecting to disconnecting when the light source is at the state of gradually varying the brightness and at the instant of disconnecting the light source driving circuit; and thereby the analyzing and processing module searches out the constant brightness state of the light source correspondent to the period in the predefined firmware program and then stores the information about the constant brightness state in the storage module.

The MCU further comprises a signal sampling module for obtaining at least one of the current value and the voltage value of the output terminal of the light source driving circuit when the light source is at the state of gradually varying the brightness and at the instant of disconnecting the light source driving circuit and then sending the obtained value or the obtained values into the analyzing and processing module; and thereby the analyzing and processing module stores the current value or the voltage value in the storage module.

The present invention also provides a light adjustable lamp comprising a light source and a device for driving light adjustments connected to the light source, wherein the device is as mentioned above.

The energy storing elements comprise one kind or more than one kind of capacitors and inductors.

The present invention has following beneficial technical effects.

The MCU of the present invention generates the signal for controlling the brightness of the light source by obtaining on and off signal of the switch which is connected to the light source driving circuit, i.e., by obtaining the connecting signal and the disconnecting signal of the light source driving circuit, and then outputs the signal for controlling the brightness of light source into the light source driving circuit, which is an ingenious manner and has a simple structure without being provided with unnecessary knobs or remote controllers for the light adjustments, so as to greatly reduce the upgrading costs of conventional lighting lamps; and meanwhile the conventional lamps can be upgraded by only replacing the lamps because the switches are used, so as to greatly save engineering costs.

After the switch is turned off, the energy storing elements in the light source driving circuit continue to supply the light source with electricity, so that the light source is prevented from being extinguished after the switch is turned off and maintains constant brightness within the switch acting time, so as to ensure a continuity of electricity supply and bring convenience to adjusting light.

A continuous linear light adjustment can be accomplished by choosing only once, either by choosing a desired brightness instead of frequently switching between ON and OFF to simplify controlling, or by freely controlling the brightness of the light source. The continuous linear light adjustment is more advanced compared to conventional arts.

These and other objectives, features, and advantages of the present invention will become apparent from the following detailed description, the accompanying drawings, and the appended claims.

DETAILED DESCRIPTION OF THE PREFERRED EMBODIMENT

The present invention provides a method for driving light adjustments, a device therefor and a light adjustable lamp comprising the device. The device cooperates with an on-off switch and collects on and off signal of the switch to linearly and freely adjust brightness of a light source correspondent to the on and off signal. The present invention has a simple controlling manner and low costs and prevents lights from being extinguished during the light adjustments to bring convenience to the light adjustments without reducing a service life of the light source.

Combined with preferred embodiments and drawings, the present invention is further illustrated and described as follows.

First Preferred Embodiment

Figure 1:
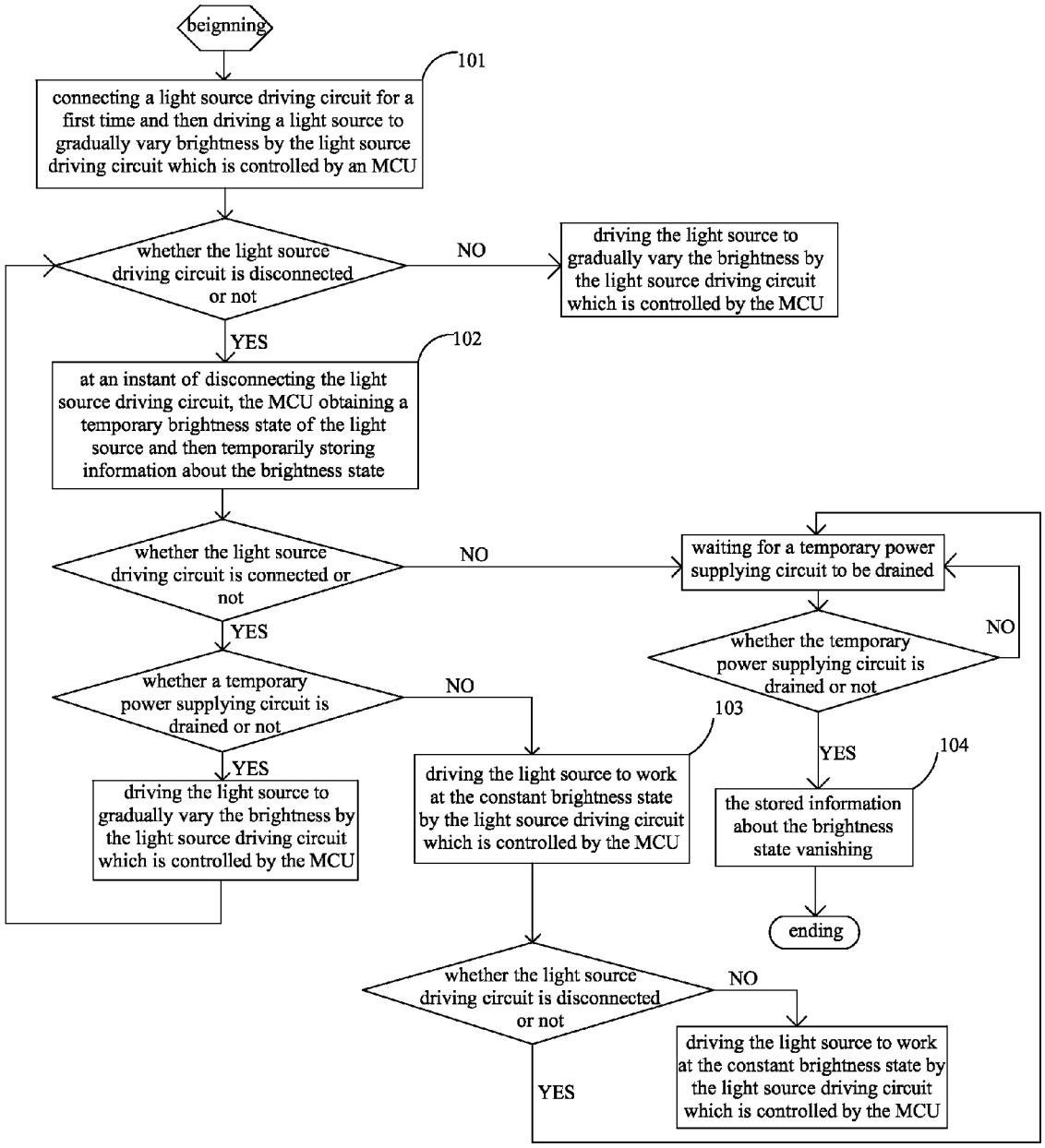
FIG. 1 is a flow chart of a method for driving light adjustments according to a first preferred embodiment of the present invention.
Figure 2:
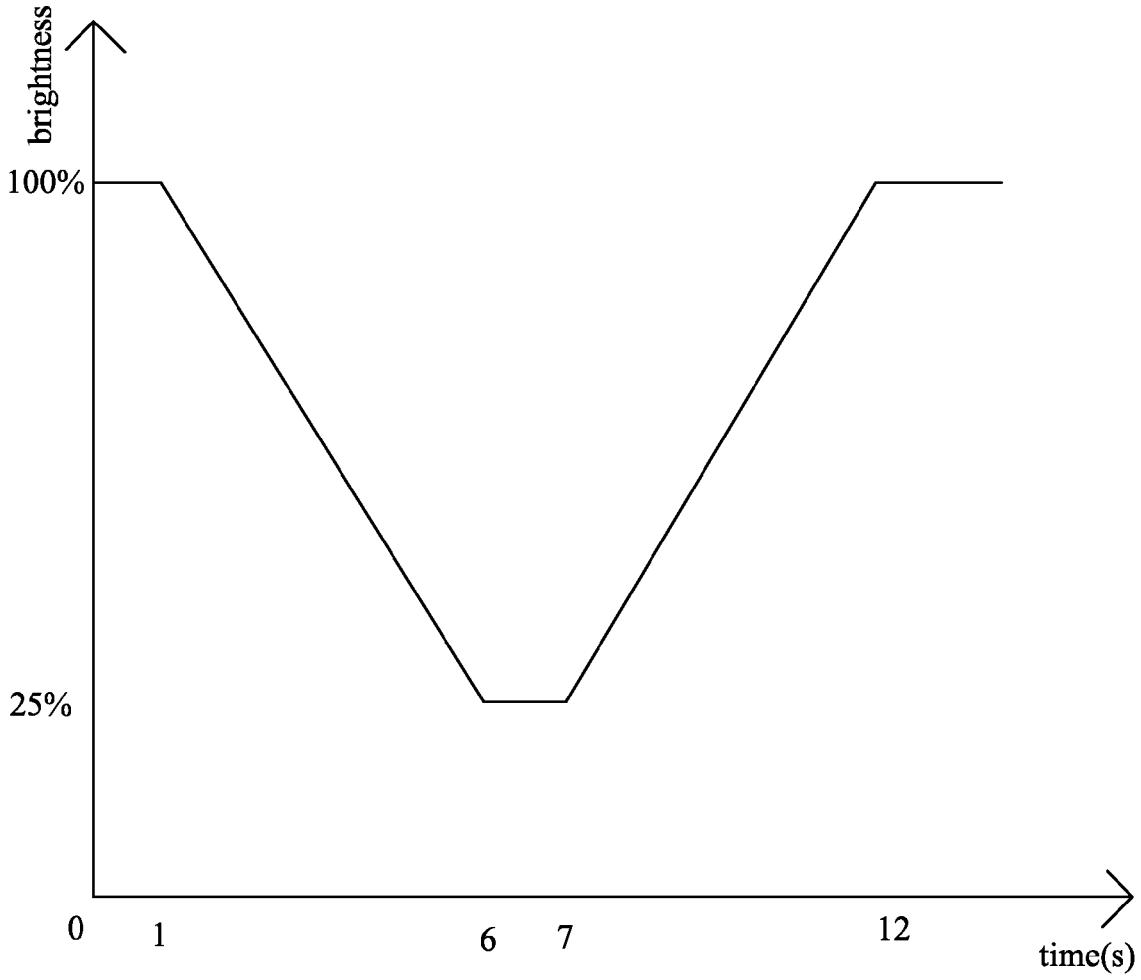
FIG. 2 is a curve diagram of brightness changes of a light source according to the first preferred embodiment of the present invention.

Referring to FIG. 1 of the drawings, according to the first preferred embodiment of the present invention, a method for driving light adjustments which controls brightness of a light source based on signal for controlling the brightness of the light source which is sent into a light source driving circuit via an MCU specifically comprises following steps of:

101: for a first time connecting the light source driving circuit and then driving the light source to gradually vary the brightness by the light source driving circuit which is controlled by the MCU, specifically comprising following steps of: firming a program in the MCU, wherein the program corresponds to the controlling signal which drives the light source to work at a gradually varying state firstly from bright to dark and then from dark back to bright; connecting the light source driving circuit by turning on a switch of the light source driving circuit for a first time and then the light source driving circuit starting to supply the MCU and the light source with electricity; after the light source driving circuit is connected, the MCU starting to work and meanwhile the light source lightening; then driving the light source to work at a state varying from bright to dark and then from dark back to bright by the light source driving circuit which is controlled by the MCU, wherein FIG. 2 shows the varying order; before the switch is turned off, the light source keeping varying the brightness by repeating the varying order; and when the switch of the light source driving circuit is turned off, the light source stopping varying, wherein the controlling signal is PWM controlling signal;

102: at an instant of disconnecting the light source driving circuit, the MCU obtaining a temporary brightness state of the light source at the instant and then temporarily storing information about the brightness state which is constant, specifically comprising following steps of: when the light source is working at the state of step 101, turning off the switch so that the light source driving circuit is disconnected and stops supplying the MCU with electricity, but then a temporary power supplying circuit continuing to supply the MCU with electricity so that the MCU continues being driven to work; the MCU obtaining a connecting signal or a disconnecting signal of the light source driving circuit by detecting a current signal of the light source driving circuit; when the MCU detects that the light source driving circuit is disconnected, the MCU obtaining an operating period of the light source driving circuit from connecting to disconnecting, according to the operating period searching out the brightness state of the light source at the instant of disconnecting the light source driving circuit in the firmware program and storing the information about the brightness state, wherein a time of supplying the MCU with electricity by the temporary power supplying circuit depends on a discharging time of energy storing elements of the temporary power supplying circuit and the energy storing elements can be inductors, capacitors or cells; and when the light source driving circuit is disconnected continuously and after the temporary power supplying circuit is drained, the stored information about the brightness state vanishing;

103: when the brightness state remains, again connecting the light source driving circuit and driving the light source to work at the constant brightness state of step 102 by the light source driving circuit which is controlled by the MCU, specifically comprising following steps of: before the temporary power supplying circuit is drained, i.e., when the temporary power supplying circuit is driving the MCU to work, turning on the switch so that the light source driving circuit is connected to supply the MCU and the light source with electricity again, and thus the light source lightening again and the MCU continuing working to detect that the light source driving circuit is connected; and in a situation that the firmware program and the information about the brightness state simultaneously exist, the MCU preferably extracting the stored brightness state for analyzing and driving the light source to work at the brightness state by the light source driving circuit which is controlled by the MCU;

wherein the light source driving circuit is connected after the temporary power supplying circuit is drained; when the temporary power supplying circuit is drained, the stored information about the brightness state vanishes and thus even if the light source driving circuit is connected again, the MCU only extracts the firmware program and then the light source driving circuit is controlled by the MCU to drive the light source to vary the brightness at the varying order as mentioned in step 101; and wherein within a certain period the temporary power supplying circuit runs out of electricity and then the information about the brightness state which is stored by the MCU vanishes; when the temporary power supplying circuit is drained, turning on the switch again results in that the light source varies the brightness at the varying order as the switch is turned on for the first time, i.e., at the varying order as mentioned in step 101; and thus the connecting for the first time means connecting the light source driving circuit after the temporary power supplying circuit is drained, wherein it takes 2 s-10 s for the temporary power supplying circuit to run out of electricity; and

104: disconnecting the light source driving circuit when the light source is working at the constant brightness state, thereafter waiting for the temporary power supplying circuit to be drained, connecting the light source driving circuit after the temporary power supplying circuit is drained and then driving the light source to gradually vary the brightness by the light source driving circuit which is controlled by the MCU, wherein, after being disconnected, the light source driving circuit is connected before the temporary power supplying circuit is drained, which means the stored brightness state still exists and thus the light source driving circuit is controlled by the MCU to drive the light source to work at the constant brightness state.

Second Preferred Embodiment

Figure 3:
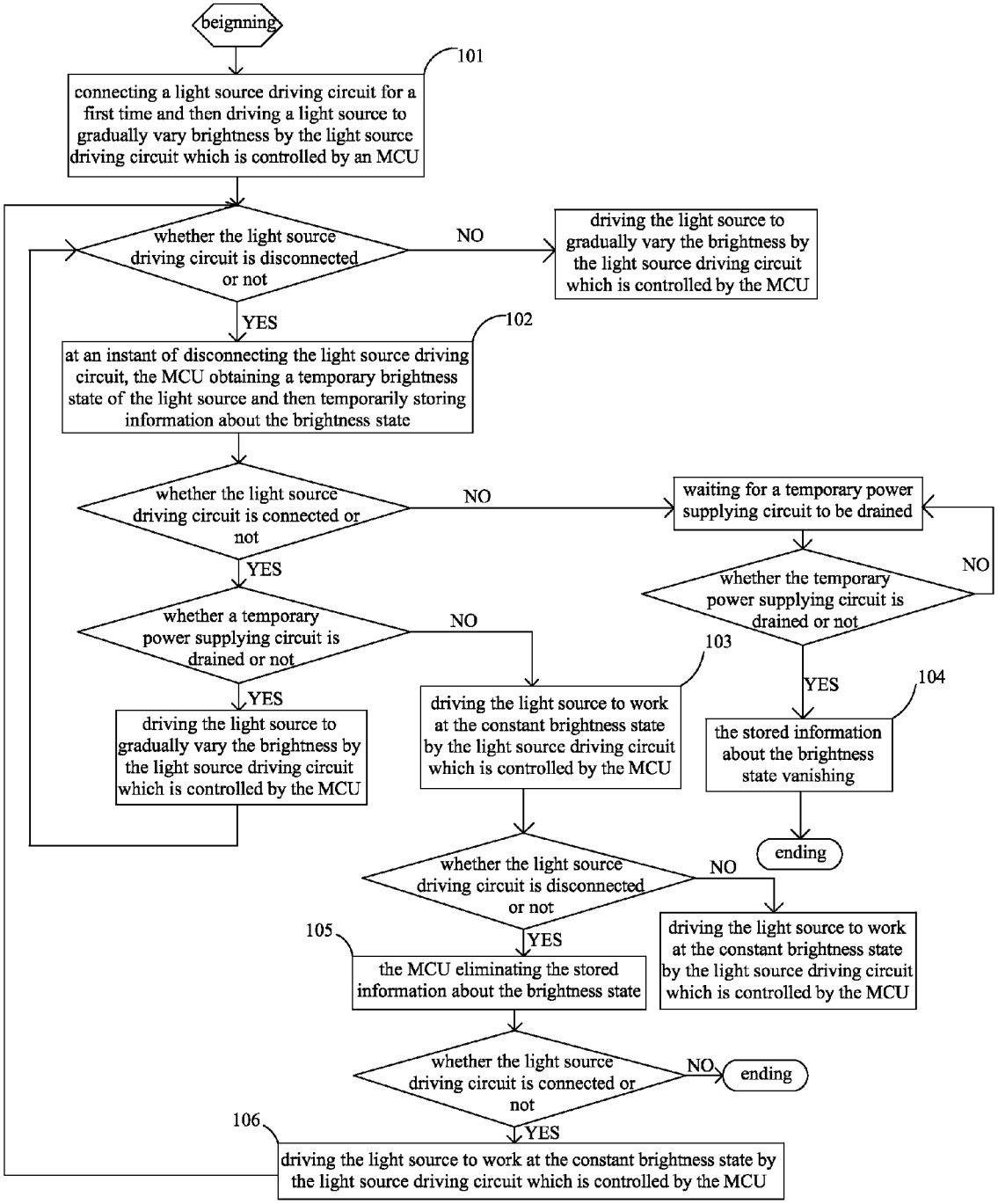
FIG. 3 is a flow chart of the method according to a second preferred embodiment of the present invention.

According to the first preferred embodiment of the present invention, it is necessary for the light source not to vary at the varying order as mentioned in step 101 until the temporary power supplying circuit is drained and the switch is turned on, i.e., the light source driving circuit is connected. However, the light source begins to gradually vary the brightness after the switch is turned on for the first time; users usually miss desired brightness state when the users are choosing and then the users have to choose again; if the users are choosing again, the users have to wait for the temporary power supplying circuit to run out of electricity; and further if it takes a long time for the temporary power supplying circuit to discharge, the users are kept waiting too long, which brings great inconvenience to the light adjustments. Based on the first preferred embodiment, as showed in FIG. 3, the method according to the second preferred embodiment further comprises following steps of:

105: when the light source is working at the brightness state and when the information about the brightness state remains, disconnecting the light source driving circuit and the MCU eliminating the stored information about the brightness state, specifically comprising following steps of: after step 103, the light source working at the constant brightness state and meanwhile the MCU still having the information about the brightness state stored therein; turning off the switch so that the light source driving circuit stops supplying the MCU with electricity while the temporary power supplying circuit continues to supply the MCU with electricity; and the MCU continuing working and when the MCU detects that the light source driving circuit is disconnected, the MCU eliminating the stored information about the brightness state of the working light source without waiting for the temporary power supplying circuit to be drained; and

106: connecting the light source driving circuit after the MCU eliminates the stored information about the brightness state and then driving the light source to gradually vary the brightness by the light source driving circuit which is controlled by the MCU, specifically comprising following steps of: after step 104, the MCU having already eliminated the stored information about the brightness state; turning on the switch no matter whether the temporary power supplying circuit is drained or not so that the light source driving circuit supplies the MCU and the light source with electricity again; and because of the vanishing of the information about the brightness state stored in the MCU, the MCU extracting only the stored firmware program and converting the firmware program into a signal for controlling the light source driving circuit which drives the light source to vary at the varying order as mentioned in step 101.

The above design has an advantage that, if the users miss the desired brightness when choosing, the users can switch off and readily switch on to choose again without waiting, which improves convenience of the light adjustments.

Following are some necessary illustration.

In the first preferred embodiment and the second preferred embodiment of the present invention, the light source driving circuit supplies the MCU and the light source with electricity. After the switch is turned off, the light source driving circuit is switched off and stops supplying the light source with electricity; and further, each light adjustment requires turning off the switch, so as to further stop the light source from being supplied with electricity. If each light adjustment has to extinguish the light source, the light adjustment becomes a bother in users' work and life; and along with frequently switching on and off, it is certain that a service life of the light source is greatly shortened. Thus it is necessary to provide the energy storing elements for temporarily supplying the light source with electricity after turning off the switch, which specifically comprises that the light source driving circuit comprises the energy storing elements and the energy storing elements continue to supply the light source with electricity after the light source driving circuit stops supplying the light source with electricity. The energy storing elements independently supply the light source with electricity after the switch is turned off and then the light source driving circuit recharges the energy storing elements after the switch is turned on; and thus the energy storing elements are preferred to be the capacitors or the inductors. Because the energy storing elements are designed to supply the light source with electricity, the light source maintains identical brightness even at the instant of turning off the switch; in other words, the light source has a current value and a voltage value unchanged. The energy storing elements are provided at an output terminal of the light source driving circuit. Thus when the light source is in the state of gradually varying the brightness and at the instant of disconnecting the light source driving circuit, the MCU obtains at least one of the current value and the voltage value of the output terminal of the light source driving circuit at the instant, wherein the current value and the voltage value correspond to the brightness state of the light source when the light source driving circuit is disconnected; and the MCU temporarily stores the current value and the voltage value, which equals storing the information about the brightness state of the light source when the light source driving circuit is disconnected.

Third Preferred Embodiment

Figure 4:
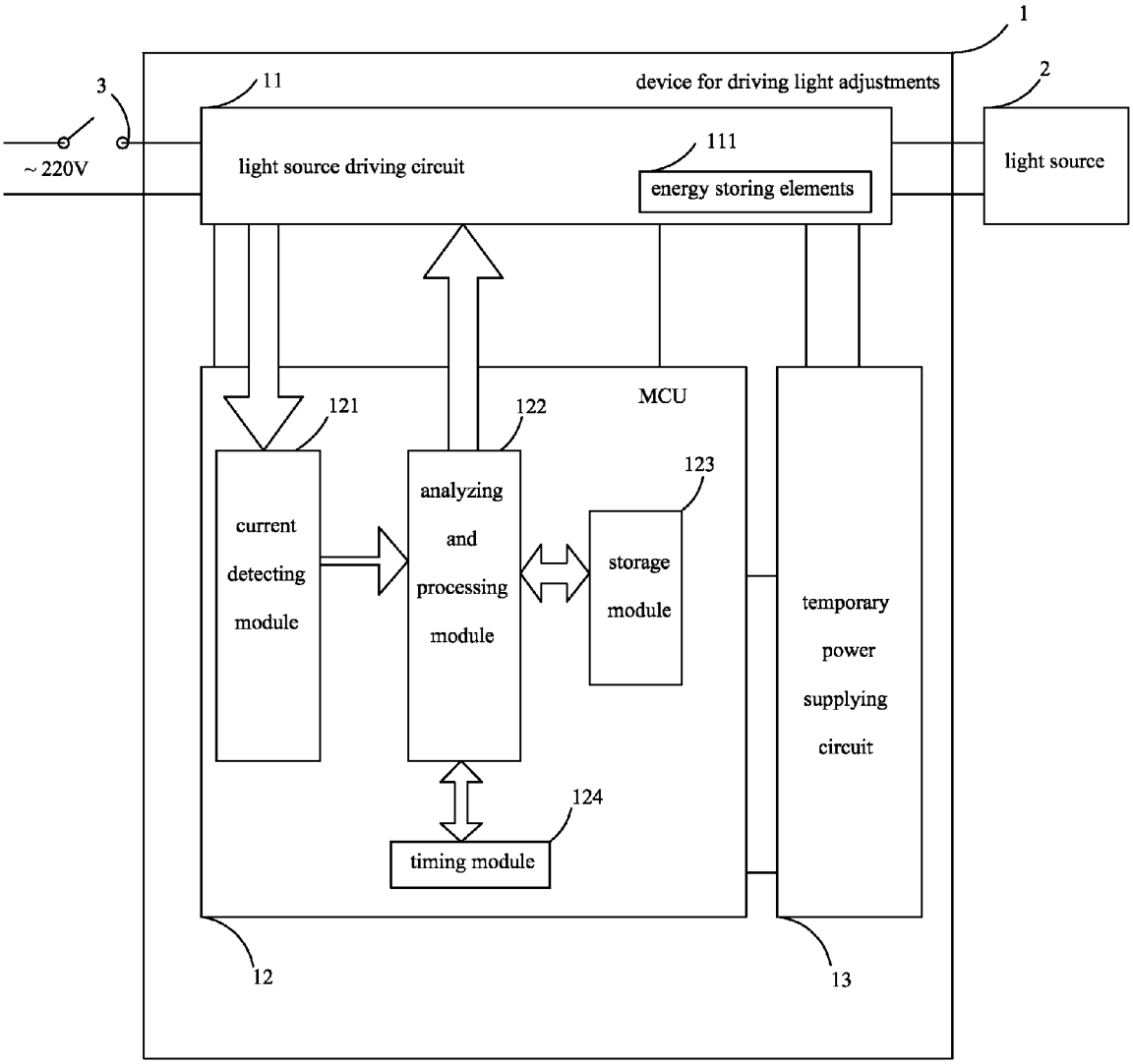
FIG. 4 is a block diagram of a light adjustable lamp according to a third preferred embodiment of the present invention.
Figure 5:
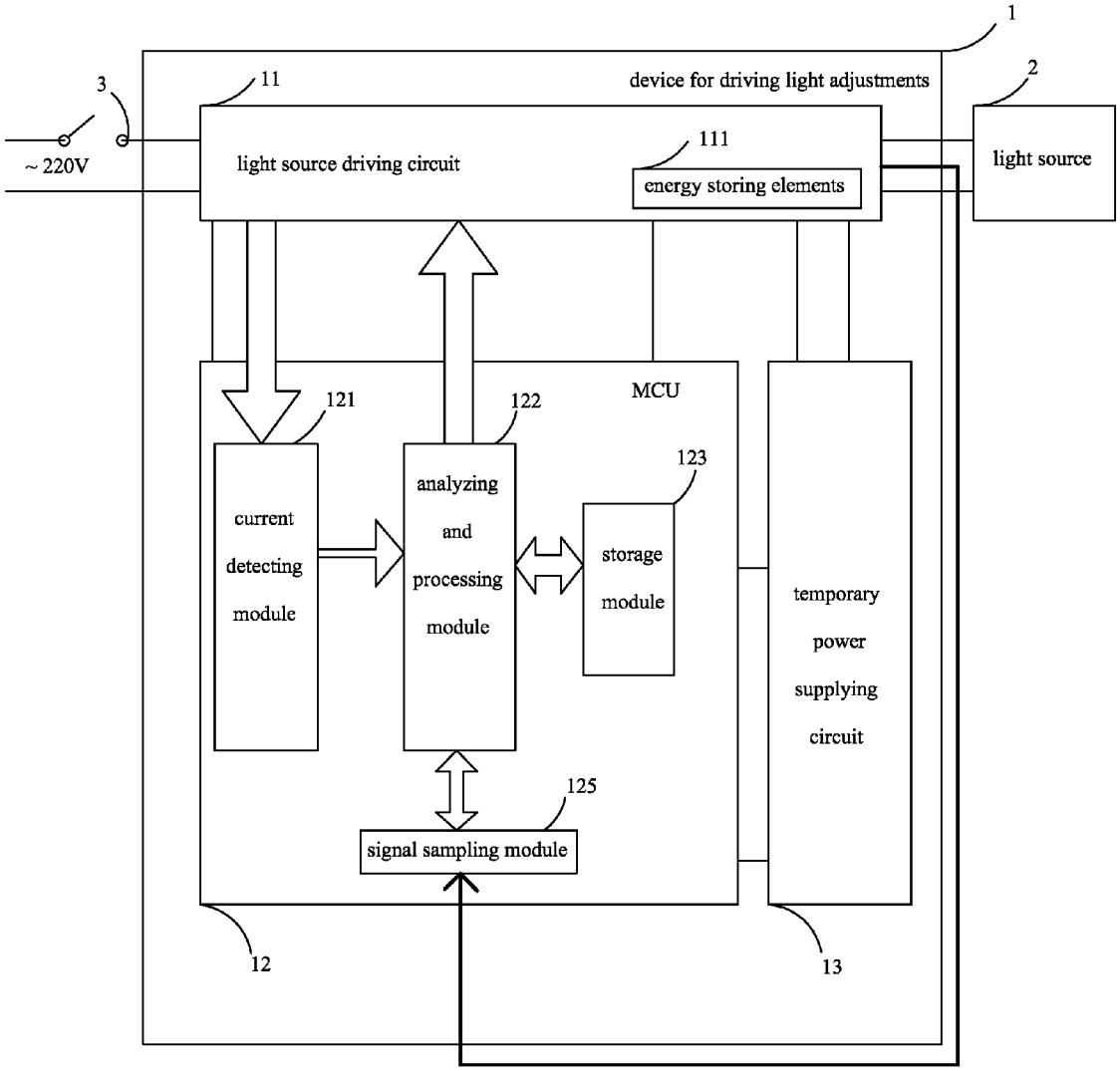
FIG. 5 is a block diagram of the light adjustable lamp according to a fourth preferred embodiment of the present invention.

As showed in FIG. 4, according to the third preferred embodiment of the present invention, a light adjustable lamp comprises a device for driving light adjustments 1 and a light source 2 connected to the device, wherein a switch 3 controls the device. In practical application, the light adjustable lamp is provided on a seat which is provided on walls or on ceilings and thus the light adjustable lamp is hardly accessible to the users; however, the switch is provided on the walls and accessible to the users. The device 1 comprises a light source driving circuit 11, an MCU 12 and a temporary power supplying circuit 13. The light source driving circuit 11 is for supplying the MCU 12 and the light source 2 with electricity. The temporary power supplying circuit 13 is for continuing to supply the MCU 12 with electricity after the light source driving circuit 11 stops supplying the MCU 12 with electricity. The light source driving circuit 11 is also for charging the temporary power supplying circuit 13. The light source driving circuit 11 further comprises energy storing elements 111 for continuing to supply the light source 2 with electricity after the switch 3 which is connected to the light source driving circuit 11 is turned off. The MCU 12 comprises a current detecting module 121, an analyzing and processing module 122 and a storage module 123. The current detecting module 121 is for obtaining connecting signal and disconnecting signal of the light source driving circuit 11 and then sending the obtained signal into the analyzing and processing module 122. The storage module 123 is for storing a firmware program of gradually varying brightness of the light source and information about a constant brightness state of the light source. The analyzing and processing module 122 obtains the connecting signal or the disconnecting signal of the light source driving circuit 11 and the firmware program of gradually varying the brightness of the light source or the information of the constant brightness state of the light source which is stored in the storage module 123 for analyzing and processing, generates signal for adjusting the brightness of the light source and sends the signal into the light source driving circuit 11. Then the light source driving circuit 11 adjusts the brightness of the light source 2 according to the controlling signal.

When the light source driving circuit is connected for a first time, the current detecting module 121 obtains the connecting signal of the light source driving circuit 11 and sends the connecting signal into the analyzing and processing module 122; the analyzing and processing module 122 obtains the connecting signal and extracts the firmware program of gradually varying the brightness of the light source from the storage module 123 for analyzing and processing, wherein an order of varying the brightness is showed in FIG. 2, and generates the controlling signal for controlling the light source driving circuit 11 which drives the light source 2 to gradually vary the brightness according to the predefined firmware program.

The MCU 12 further comprises a timing module 124 for obtaining a period of the light source driving circuit 11 from connecting to disconnecting when the light source 2 is in a state of gradually varying the brightness and at an instant of disconnecting the light source driving circuit 11. The analyzing and processing module 122 searches the constant brightness state of the light source correspondent to the period out in the predefined program and temporarily stores the information about the constant brightness state. The timing module 124 starts clocking after the light source driving circuit 11 is connected for the first time and stops clocking when the light source driving circuit 11 is disconnected. When the light source driving circuit 11 is connected for the first time, the analyzing and processing module 122 obtains the connecting signal and sends a clocking instruction into the timing module 124. At the instant of disconnecting the light source driving circuit 11, the current detecting module 121 sends a signal of disconnecting the light source driving circuit 11 into the analyzing and processing module 122. The analyzing and processing module 122 obtains the disconnecting signal and sends an instruction of stopping clocking into the timing module 124. The timing module 124 calculates period information from connecting to disconnecting and sends the period information into the analyzing and processing module 122. The analyzing and processing module obtains the period information, searches out the constant brightness state of the light source which corresponds to the period via a combination with the firmware program stored in the storage module 123 and stores the information about the constant brightness state in the storage module 123.

After the light source driving circuit 11 is disconnected, the temporary power supplying circuit 13 continues to supplying the MCU 12 with electricity, which means that the temporary power supplying circuit is discharging; and after the temporary power supplying circuit is drained, the information about the constant brightness state stored in the storage module 123 vanishes.

When the switch 3 is turned on again in a short time after turning on the switch 3 for the first time and before the temporary power supplying circuit 13 is drained, the information about the constant brightness state stored in the storage module 123 still exists; the current detecting module 121 obtains the connecting signal of the light source driving circuit 11 and sends the connecting signal into the analyzing and processing module 122; and when the storage module 123 simultaneously have the firmware program and the information about the constant brightness state stored therein, the analyzing and processing module 122 preferably extracts the brightness state from the storage module 123 for analyzing and processing, and thereafter generates the signal for controlling the light source driving circuit which drives the light source to work at the constant brightness state.

When the switch 3 maintains open for some time after the switch 3 is turned on for the first time and after the temporary power supplying circuit 13 is drained, the information about the constant brightness state stored in the storage module 123 vanishes; the current detecting module 121 obtains the connecting signal of the light source driving circuit 11 and sends the connecting signal into the analyzing and processing module 122; and in a situation that the storage module 123 only have the firmware program stored therein, the analyzing and processing module 122 extracts the firmware program for analyzing and processing, and thereafter generates the signal for controlling the light source driving circuit 11 which drives the light source to gradually vary the brightness according to the predefined firmware program.

When the light source is working at the constant brightness state and when the information about the constant brightness state remains, the lights source driving circuit is disconnected; then the analyzing and processing module 122 obtains the disconnecting signal of the light source driving circuit 11 which is sent by the current detecting module 121 and eliminates the information about the constant brightness state stored in the storage module 123, wherein such a design has the advantage as illustrated in the second preferred embodiment without repeating herein.

A first process of choosing the brightness of the light source is accomplished from turning on the switch for the first time through turning off the switch to turning on the switch again. From turning off the switch again, the chosen brightness of the light source is cancelled. After the temporary power supplying circuit is drained, turning on the switch for a third time initiates a second process of choosing the brightness of the light source.

Fourth Preferred Embodiment

According to the third preferred embodiment of the present invention, the MCU is provided with the timing module 124 for obtaining a period of the light source driving circuit 11 from connecting to disconnecting when the light source 2 is in a state of gradually varying the brightness and at an instant of disconnecting the light source driving circuit 11. The analyzing and processing module 122 searches the constant brightness state of the light source correspondent to the period out in the predefined program and temporarily stores the information about the constant brightness state. Different from the third preferred embodiment, according to the fourth preferred embodiment, the MCU is provided with a signal sampling module 125 for obtaining at least one of a current value and a voltage value of the working light source 2 when the light source 2 is at the state of gradually varying the brightness and at the instant of disconnecting the light source driving circuit 11 and sending the obtained value or values into the analyzing and processing module 122 which stores the value or values in the storage module 123. The light source driving circuit 11 is provided with the energy storing elements 111. The energy storing elements 111 supply the light source with unchanged current and voltage at the instant of disconnecting the light source driving circuit 11; and meanwhile the current detecting module 121 sends the disconnecting signal of the light source driving circuit 11 into the analyzing and processing module 122. After obtaining the disconnecting signal of the light source driving circuit, the analyzing and processing module 122 readily sends the signal sampling module 125 the current value or the voltage value which is sent into the light source 2 by an output terminal of the light source driving circuit 11, wherein the current value and the voltage value at this moment correspond to the brightness state of the light source at this moment; and then the signal sampling module 125 obtains the current value or the voltage value of the light source 2 and sends the obtained current value or the obtained voltage value into the analyzing and processing module which stores the current value or the voltage value in the storage module. When the light source driving circuit is connected again, the analyzing and processing module extracts the current value or the voltage value for analyzing and processing and then generates the signal for controlling the light source driving circuit which drives the light source to work according to the current value or the voltage value.

According to the fourth preferred embodiment of the present invention, the current detecting module 121 detects current signal of an input terminal of the light source driving circuit 11; and different from the current detecting module 121, the signal sampling module 125 collects the current value and the voltage value of the output terminal of the light source driving circuit 11. Moreover, if the output terminal of the light source driving circuit 11 is provided with no energy storing elements 111, the light source driving circuit supplies the light source with no current and no voltage after being disconnected and further the signal sampling module is unable to collect the current value or the voltage value of the working light source at the instant of disconnecting the light source driving circuit 11.

Meanwhile it is necessary to mention that the MCU needs to be supplied with stable current and stable voltage by the temporary power supplying circuit, so as to work effectively and ensure a stability of data according to the third preferred embodiment and the fourth preferred embodiment of the present invention. Large-capacity capacitors or cells are preferred.

Based on the above principles of adjusting the brightness of the light source, colors of the light source can also be adjustable, just by replacing the firmware program with the colors varying according to a desire order. One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method for driving light adjustments, comprising following steps of:

for a first time connecting a light source driving circuit which supplies a light source and an MCU with electricity, and thereafter driving the light source to gradually vary brightness according to a predefined firmware program by the light source driving circuit which is controlled by the MCU;

after the light source driving circuit is disconnected, a temporary power supplying circuit continuing to supplying the MCU with electricity;

when the light source is at a state of gradually varying the brightness and at an instant of disconnecting the light source driving circuit, the MCU obtaining a temporary brightness state of the light source at the instant of disconnecting the light source driving circuit and then temporarily storing information about the brightness state;

after the temporary power supplying circuit is drained, the stored information about the brightness state vanishing;

connecting the light source driving circuit when the information about the brightness state remains, and then driving the light source to work according to the information about the constant brightness state by the light source driving circuit which is controlled by the MCU; and connecting the light source driving circuit after the information about the brightness state vanishes, and then driving the light source to gradually vary the brightness according to the predefined firmware program by the light source driving circuit which is controlled by the MCU; and further comprising following step of:

when the light source is working at the constant brightness state and when the information about the brightness state remains, disconnecting the light source driving circuit and then the MCU eliminating the stored information about the brightness state.

2. The method, as recited in claim 1, wherein the step of "when the light source is at a state of gradually varying the brightness and at an instant of disconnecting the light source driving circuit, the MCU obtaining a temporary brightness state of the light source at the instant of disconnecting the light source driving circuit and then temporarily storing information about the brightness state" specifically comprises:

when the light source is at the state of gradually varying the brightness and at the instant of disconnecting the light source driving circuit, the MCU obtaining a period of the light source driving circuit from connecting to disconnecting, then searching out the brightness state of the light source correspondent to the period in the predefined firmware program and temporarily storing the information about the brightness state.

3. The method, as recited in claim 1, wherein the step of "when the light source is at a state of gradually varying the brightness and at an instant of disconnecting the light source driving circuit, the MCU obtaining a temporary brightness state of the light source at the instant of disconnecting the light source driving circuit and then temporarily storing information about the brightness state" specifically comprises:

when the light source is at the state of gradually varying the brightness and at the instant of disconnecting the light source driving circuit, the MCU obtaining at least one of a current value and a voltage value of the working light source when the light source driving circuit is disconnected and then temporarily storing the obtained value or the obtained values.

4. A method for driving light adjustments, comprising following steps of:

for a first time connecting a light source driving circuit which supplies a light source and an MCU with electricity, and thereafter driving the light source to gradually vary brightness according to a predefined firmware program by the light source driving circuit which is controlled by the MCU;

after the light source driving circuit is disconnected, a temporary power supplying circuit continuing to supplying the MCU with electricity;

when the light source is at a state of gradually varying the brightness and at an instant of disconnecting the light source driving circuit, the MCU obtaining a temporary brightness state of the light source at the instant of disconnecting the light source driving circuit and then temporarily storing information about the brightness state;

after the temporary power supplying circuit is drained, the stored information about the brightness state vanishing;

connecting the light source driving circuit when the information about the brightness state remains, and then driving the light source to work according to the information about the constant brightness state by the light source driving circuit which is controlled by the MCU; and connecting the light source driving circuit after the information about the brightness state vanishes, and then driving the light source to gradually vary the brightness according to the predefined firmware program by the light source driving circuit which is controlled by the MCU;

wherein the light source driving circuit comprises energy storing elements which continue to supply the light source with electricity after the light source driving circuit stops supplying the light source with electricity; and further comprising following step of:

when the light source is working at the constant brightness state and when the information about the brightness state remains, disconnecting the light source driving circuit and then the MCU eliminating the stored information about the brightness state.

5. The method, as recited in claim 4, wherein the step of "when the light source is at a state of gradually varying the brightness and at an instant of disconnecting the light source driving circuit, the MCU obtaining a temporary brightness state of the light source at the instant of disconnecting the light source driving circuit and then temporarily storing information about the brightness state" specifically comprises:

when the light source is at the state of gradually varying the brightness and at the instant of disconnecting the light source driving circuit, the MCU obtaining a period of the light source driving circuit from connecting to disconnecting, then searching out the brightness state of the light source correspondent to the period in the predefined firmware program and temporarily storing the information about the brightness state.

6. The method, as recited in claim 4, wherein the step of "when the light source is at a state of gradually varying the brightness and at an instant of disconnecting the light source driving circuit, the MCU obtaining a temporary brightness state of the light source at the instant of disconnecting the light source driving circuit and then temporarily storing information about the brightness state" specifically comprises:

when the light source is at the state of gradually varying the brightness and at the instant of disconnecting the light source driving circuit, the MCU obtaining at least one of a current value and a voltage value of the working light source when the light source driving circuit is disconnected and then temporarily storing the obtained value or the obtained values.

7. A device for driving light adjustments, comprising a light source driving circuit, and further comprising an MCU and a temporary power supplying circuit, wherein said temporary power supplying circuit is for supplying said MCU with electricity after said light source driving circuit stops supplying said light source with electricity; and said MCU comprises a current detecting module, an analyzing and processing module and a storage module, wherein said current detecting module is for obtaining a connecting signal or a disconnecting signal of said light source driving circuit and sending said obtained signal into said analyzing and processing module; said storage module is for storing a firmware program of gradually varying brightness of said light source and information about constant brightness state of said light source; said analyzing and processing module obtains said connecting signal or said disconnecting signal of said light source driving circuit and said firmware program of gradually varying said brightness of said light source or said information about said constant brightness state of said light source which is stored in said storage module for analyzing and processing, then generates a signal for adjusting said brightness of said light source and sends said signal into said light source driving circuit; and said light source driving circuit adjusts said brightness of said light source according to said controlling signal, specifically comprising that:

after said light source driving circuit is connected for a first time, said analyzing and processing module generates a signal for controlling said light source driving circuit which drives said light source to gradually vary said brightness according to said predefined program;

when said light source is at a state of gradually vary said brightness and after said light source driving circuit is disconnected, said analyzing and processing module obtains said constant brightness state at an instant of disconnecting said light source driving circuit and temporarily stores said information about said constant brightness state in said storage module;

when said information about said brightness state remains, said light source driving circuit is connected again after the first time and said analyzing and processing module generates said signal for controlling said light source driving circuit which drives said light source to work according to said information about said constant brightness state; and after said information about said brightness state vanishes, said light source driving circuit is connected again after the first time and said analyzing and processing module generates said signal for controlling said light source driving circuit which drives said light source to gradually vary said brightness according to said predefined firmware program;

wherein said light source driving circuit comprises energy storing elements which continue to supply said light source with electricity after said light source driving circuit stops supplying said light source with electricity; and wherein said analyzing and processing module is also for eliminating said stored information about said constant brightness state after said light source driving circuit is disconnected, when said light source is working at said constant brightness state and when said information about said constant brightness state remains.

8. The device, as recited in claim 7, wherein said MCU further comprises a timing module for obtaining a period of said light source driving circuit from connecting to disconnecting when said light source is in said state of gradually varying said brightness and at the instant of disconnecting said light source driving circuit; and said analyzing and processing module searches out said constant brightness state of said light source which corresponds to said period in said predefined firmware program and temporarily stores said information about said brightness state in said storage module.

9. The device, as recited in claim 7, wherein said MCU further comprises a signal sampling module for obtaining at least one of a current value and a voltage value of said working light source when said light source is at said state of gradually varying said brightness and at the instant of disconnecting said light source driving circuit and then sending said obtained value or said obtained values into said analyzing and processing module, wherein said analyzing and processing module stores said current value and said voltage value in said storage module.

* * * * *